United States Patent [19]

Bennett

[11] 4,267,753

[45] May 19, 1981

[54] APPARATUS FOR PRODUCING A BLANK FROM STOCK MATERIAL

[76] Inventor: Edward D. Bennett, 1401 S. Ocean Blvd. Apt. 902, Pompano Beach, Fla. 33062

[21] Appl. No.: 92,403

[22] Filed: Nov. 8, 1979

[51] Int. Cl.[3] ..... B21D 45/06; B21D 28/16

[52] U.S. Cl. ..... 83/124; 83/125; 83/126; 83/175; 83/389; 83/621; 83/690

[58] Field of Search ..... 83/124, 125, 126, 128, 83/389, 566, 569, 621, 622, 685, 690, 132, 140, 143, 175

[56] References Cited

U.S. PATENT DOCUMENTS

| | | | |
|---|---|---|---|
| 3,554,065 | 1/1971 | Kunz | 83/124 |
| 3,564,959 | 2/1971 | Harada | 83/124 |
| 3,570,343 | 3/1971 | Wolnosky | 83/124 |
| 3,673,908 | 7/1972 | Smith | 83/685 |

FOREIGN PATENT DOCUMENTS

| | | | |
|---|---|---|---|
| 1518132 | 2/1968 | France | 83/621 |

*Primary Examiner*—J. M. Meister
*Attorney, Agent, or Firm*—Strimbeck, Davis & Soloway

[57] ABSTRACT

The present invention relates to a method and apparatus for producing a smooth edge blank from stock material. A blanking die is carried by the movable die shoe and a closely cooperating blanking punch is secured on the fixed die shoe. Spring biassed means is displaceably provided within the blanking die to apply pressure on a sheet of stock located on the punch only over the area to be blanked out from said sheet of stock. A piercing punch may also be provided and extends coaxially through the blanking die and a bore extending through the blanking punch provides a piercing die. The spring biassed means for applying pressure to clamp the stock only over the area to be blanked is a shedder displaceably disposed within the bore of the blanking die. A stripper encircling the blanking punch is provided for removing scrap stock upon completion of the blanking step and a spacer means is disposed to space the blanking die and the stripper apart by a distance exceeding the thickness of the stock.

18 Claims, 4 Drawing Figures

APPARATUS FOR PRODUCING A BLANK FROM STOCK MATERIAL

BACKGROUND OF THE INVENTION

The present invention relates to the production of component parts by stamping a smooth edge blank from material and is concerned particularly with an improved method and apparatus for producing such stampings.

The production of stampings from stock material is either by a conventional stamping process or by a fineblanking process. A stamping produced by conventional methods suffers from the disadvantage known in the art as die break. When a stamping is produced by conventional methods, the cooperating punch and die produce an initial shearing action after which the blank is severed by fracturing. A ridge, known as "shear" extends around the edge of the stamping and divides the portion that has sheared from the portion that has fractured. The fractured portion is the "die break" and is rough and granular in nature. As the thickness of the blank from which the stamping is produced increases so does the problem of die break.

The problem of die break is largely averted by the known process of "fineblanking". Prior to the concept of the present invention, the process of fineblanking was carried out by positive retention of the blank and stock material in such manner as to prevent die break when the punch and die perform their blanking operation. By eliminating the die break portion the entire edge of the stamping is shear and there is no fracture.

Fineblanking finds particular application where component parts having close tolerances are required since when a blank is produced by fineblanking many subsequent machining operations, such as grinding, milling, etc., are rendered unnecessary. Although the process of fineblanking has these beneficial and advantageous features, it suffers also from substantial drawbacks. Two of the most serious drawbacks are the need to provide a special press and the slow speed of operation of such a press.

The special press for performing fineblanking operations has hitherto been a triple action punch press which operates to provide three required forces. These forces, which are shear pressure, "vee ring" pressure and counter pressure, necessitate the provision of a special press which is particularly expensive and must be extremely robust to provide sufficient support to absorb reaction, sudden pressures, and all vibration.

As explained in the preceding paragraphs, known fineblanking presses must securely clamp both the blank and the stock material from which the blank is stamped. To this end, it has been necessary to provide a special component to encircle the area to be blanked out. That special component conventionally comprises an upstanding pointed ridge which serves to engage, and in fact "bite into", the stock material around the area to be blanked out. The ridge is termed a "stinger" and may be either in the form of a separate annular disc having an appropriately profiled upper surface or may, in some embodiments, be embodied in a component known as a "stripper" which is utilized to remove the surplus stock material after the stamping or blank has been removed. In either event, the precise location of the stinger and the need securely to clamp the surplus blank material necessarily results in a press which is intricate, expensive and cumbersome. Quite apart from these inherent disadvantages, it will be appreciated that the utilization of a stinger requires sufficient surplus stock material to permit the desired clamping, thereby leading to waste.

Turning now to the speed of operation, known fineblanking presses operate at speeds of up to five eighths of an inch per second. Consequently, fineblanking can better be explained as extruding metal rather than stamping metal. However, the provision of a stinger to embed in the stock material around the area to be blanked serves to hold that stock material securely during the fineblanking operation and prevent the material from flowing away from the blanking punch.

SUMMARY OF THE INVENTION

The present invention does away with the need to provide a stinger and teaches a method of producing fine edge stampings which does not involve clamping of the stock material around the area to be blanked. In other words, only the area which will be blanked is clamped during the blanking operation. The elimination of the stinger not only allows more stampings to be produced per unit length of stock material but, moreover, allows the stock material freely to flow away from the blanking punch which has the beneficial effect of reducing heat and friction around the blanking punch during stock removal thereby increasing the life of the blanking punch.

The present invention also allows the use of a standard punch press of the type commonly found in practically all metal stamping plants. This standard press, which is simple in construction when used in accordance with the present invention, is capable of operation at speeds hitherto inappropriate for fineblanking.

To this end, according to the invention there is provided a blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

Such a combination is intended to be incorporated in a stamping die. Accordingly, the present invention also provides a stamping die comprising a die set in which a blanking punch and die combination is mounted, said blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

A press of the invention may be utilized to carry out an improved method of providing a smooth edge blank. According to this aspect of the invention there is provided a method of producing a smooth edge blank from a sheet of stock by means of a punch and die dimensioned to closely mate together, the die edge being rounded, including the steps of locating the stock on the leading end of the blanking punch, exerting pressure on said located stock only over the area to be blanked and thereby leaving that portion of the stock to be removed unsupported, bringing together the mating punch and die to form the blank and remove the surplus stock while the stock to be removed is unsupported, separating said punch and die.

The invention also includes a press incorporating a stamping die comprising a die set in which a blanking punch and die combination is mounted, said blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

One feature of the method, blanking punch and die combination, stamping die and press of the invention is the provision of a rounded or radiused edge of the die which cooperates with the blanking punch. It has already been explained how the elimination of a stinger enables the surplus stock material to flow away and the provision of this rounded or radiused edge enhances such flowing away of scrap material. In fact, this feature should be considered in conjunction with the increased speed of operation made possible by the press of the invention. With regard to the increased speed of operation, the advantage obtained by the present invention can best be explained by observing that prior fineblanking presses operate to extrude metal to achieve a smooth edge whereas the present invention makes it possible to stamp the metal to produce a product having the same quality.

DESCRIPTION OF PREFERRED EMBODIMENT

Figure 1:
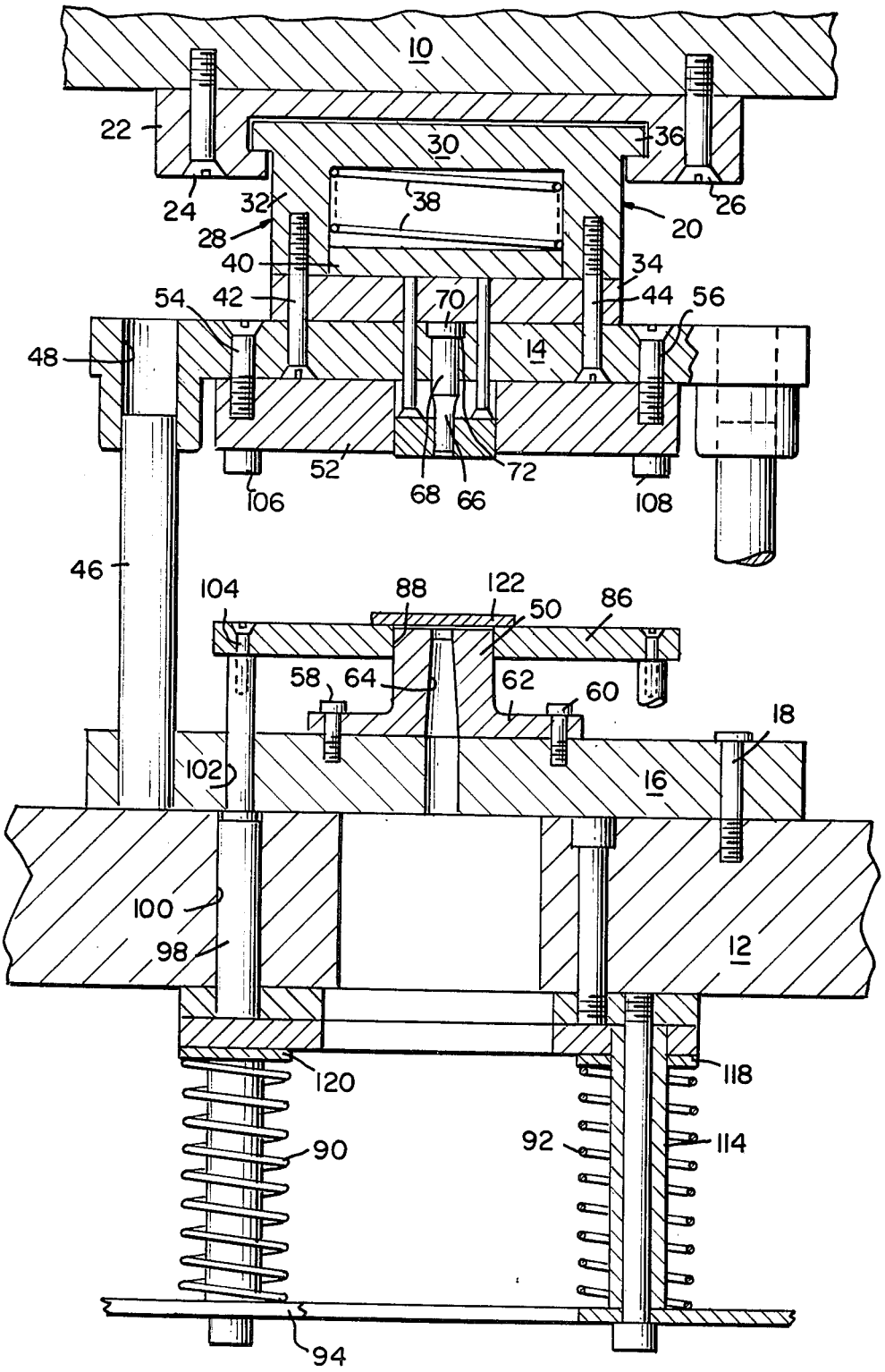
FIG. 1 is a vertical section through one embodiment of an apparatus of the invention prior to commencement of a piercing and blanking operation.

Referring now to the drawings, there is illustrated a press incorporating a stamping die for effecting a blanking operation. The illustrated press serves simultaneously both to smooth edge blank and smooth edge pierce an article from a sheet or strip of stock material in a single stamping operation.

To this end, the press incorporates a ram 10 movable towards and away from a bolster 12 by means of, for example, a rotating crankshaft (not shown).

An upper die shoe 14 is carried by the ram 10 and a lower die shoe 16 is mounted to the bolster 12. The lower die shoe is securely attached to the bolster 12 by, for example, screw means generally designated 18. In the attached drawings, similar screw means are utilized illustratively where various components of the press are to be secured to one another. It will, of course, be appreciated that such screw means represent examples only and any suitable conventional means may be utilized to secure components to one another.

The upper die shoe 14 is secured to the ram 10 through the intermediary of a spring loaded power pack generally designated 20.

The spring loaded power pack is secured in position by a T-plate 22 secured to, and carried by, the ram 10 by means of, for example, screws 24, 26. The T-channel in the T-plate 22 receives and retains a housing 28 having a base 30, depending side walls 32 and a cover 34. The base 30 has a flange or rim 36 projecting peripherally outwardly to seat within the T-channel of the T-plate 22.

The base, side walls and cover of the housing 28 define an internal chamber which accommodates a spring element or elements 38. That spring element bears on a platform 40 to urge the platform downwardly into abutting engagement with the cover 34.

The cover 34 is secured to the side walls 32 and the upper die shoe 14 is, in turn, secured to the cover 34. For convenience, and as illustrated in the drawings, this joint securing may be effected by common screws 42 and 44 extending from the die shoe 14 through the cover 34 and into the side walls 32.

It will be appreciated that with the utilization of the above described floating T arrangement, it is important to ensure that the relatively displaceable component parts of the press are at all times correctly aligned with respect to one another. To this end, guiding pillars 46 upstand from the lower die shoe and pass through registering bores 48 in the upper die shoe. Figure 1 of the drawings clearly shows one such pillar 46 and schematically indicates that at least one other similar pillar is provided. The cooperating guiding pillars and bores constrain the upper die shoe to move directly toward and away from the lower die shoe under the influence of the ram 10.

A blanking punch 50 is secured to the lower die shoe 16 and a cooperating blanking die 52 is secured to and carried by the upper die shoe 14. The drawings show the blanking die 52 secured to the upper die shoe 14 by screw means 54, 56 and the blanking punch 50 secured to the lower die shoe 62 by screw means 58, 60 extending through an outwardly directed peripheral flange 62 provided at the base of the punch 50.

The punch 50 has a concentric bore 64 extending therethrough from top to bottom, which bore 64 constitutes a piercing die. A cooperating piercing punch 66 is carried by the upper die shoe 14. As shown in the drawings, the die 66 has a barrel portion 68 disposed rearwardly of the leading end and terminating in an enlarged head 70. To receive the punch 66 the upper die shoe 14 is provided with concentric bores of different diameter to define a shoulder 72 against which the head 70 of the punch seats. The shoulder 72 prevents ejection of the punch 66 downwardly out of the upper die shoe 14 and the cover 34 prevents movement of the punch in the opposite direction.

The leading end of the punch 66, forward of the barrel portion 68, passes through a shedder 74 accommodated within a bore 76 extending through the blanking die 52. The shedder 74 serves to exert a clamping force on the stamping to restrain the latter during piercing and blanking operations. The restraining force is asserted by the spring element 38 and is transmitted from that spring element via the platform 40 and pins 78, 80 extending through aligned appropriately dimensioned bores in the cover 34 and upper die shoe 14. Although only two such pins 78, 80 are shown in the drawings, preferred embodiments of the invention utilize four such pins. As shown in the drawings, the shedder engaging ends of the pins are flared at 82 and 84 to present enlarged surfaces in contact with the shedder 74.

Whilst the piercing punch 66 is surrounded by the shedder 74, the blanking punch 50 is surrounded by a stripper 86. The stripper is in the form of a plate having a central aperture 88 dimensioned to encompass the external periphery of the blanking punch. The stripper 86 is displaceable longitudinally of the blanking punch upwardly towards a supported stamping under the influence of spring means 90, 92. The biasing spring force in this respect is transmitted by the spring means 90, 92 which abut at one end on a platform 94 and at the other end on a movable platform 96 shown most clearly in FIGS. 2 and 4. The spring biased movement of the platform 96 is transmitted to the stripper 86 by elongated pin members 98 extending through aligned bores 100, 102 extending through the bolster 12 and lower die shoe 16 respectively. In the embodiment shown in the drawings, the pin members 98 are stepped along their length with each portion of different diameter being received in mating bores 100, 102 of corresponding diameter. For convenience, the drawings show only one such pin member 98 in detail but illustrate that at least one further pin member may be provided. In fact, it is preferred to provide four such stripper biasing pin members. Each pin member 98 is attached to the stripper by, for example, screw means 104.

The operation of the press to both pierce and blank by a fineblanking operation will be described in detail hereinafter. Before detailing the sequence of operations, attention is drawn to the fact that spacers 106, 108 are carried on the under side of the blanking die 52 to control the closest spacing between the blanking die and the stripper 86. It is important to note that the depth of the spacers 106, 108 is at least twice the thickness of the stock material to be stamped.

In the embodiment shown in the drawings the bolster 12 is mounted to the punch press frame (not shown). The platform 110 is fastened to the bolster 12 by screws 112. Platform 94 and sleeves 114 are retained in position relative to platform 110 by screw bolts 116. The spring means 90, 92 are disposed around the sleeves 114 and engage the under side of the platform 96 through the intermediary of washer elements 118, 120.

Having described the overall structure of the invention, the sequence of operation of that press to perform a piercing and blanking operation will now be described.

At the beginning of an operational sequence, the above described components of the invention occupy the position shown in FIG. 1. That is to say, the ram 10 is fully withdrawn to its uppermost position to create a maximum gap between the blanking punch 50 and the blanking die 52. A strip of stock 112 from which a stamping is to be made is fed into the position shown in FIG. 1 where it overlies the uppermost surface of the blanking punch 50. Feeding of the stock may be either manually or by an automatic feed.

With the strip of stock in this position, the controls, not shown, are operated to cause the ram 10 to descend. Upon such descent of the ram a first contact between the relatively movable upper and lower parts of the stamping die is made by the spacers 106, 108 on the uppermost surface of the stripper 86. This initial contact is ensured by the fact that the depth of the spacers 106, 108 is at least twice the thickness of the stock material 122. Thereafter, continued downward movement of the ram 10 causes the stripper 86 to move downwardly against the influence of the spring means 90, 92.

Secondary contact is established between the under side of the shedder 74 and the uppermost surface of the stock 122. This secondary contact is brought about by so dimensioning the component parts of the stamping die that with the spring elements 38 in a state of minimum compression the under side of the shedder 74 stands proud of the under side of the blanking die 52 in the manner shown most clearly in FIG. 1 of the drawings.

Figure 2:
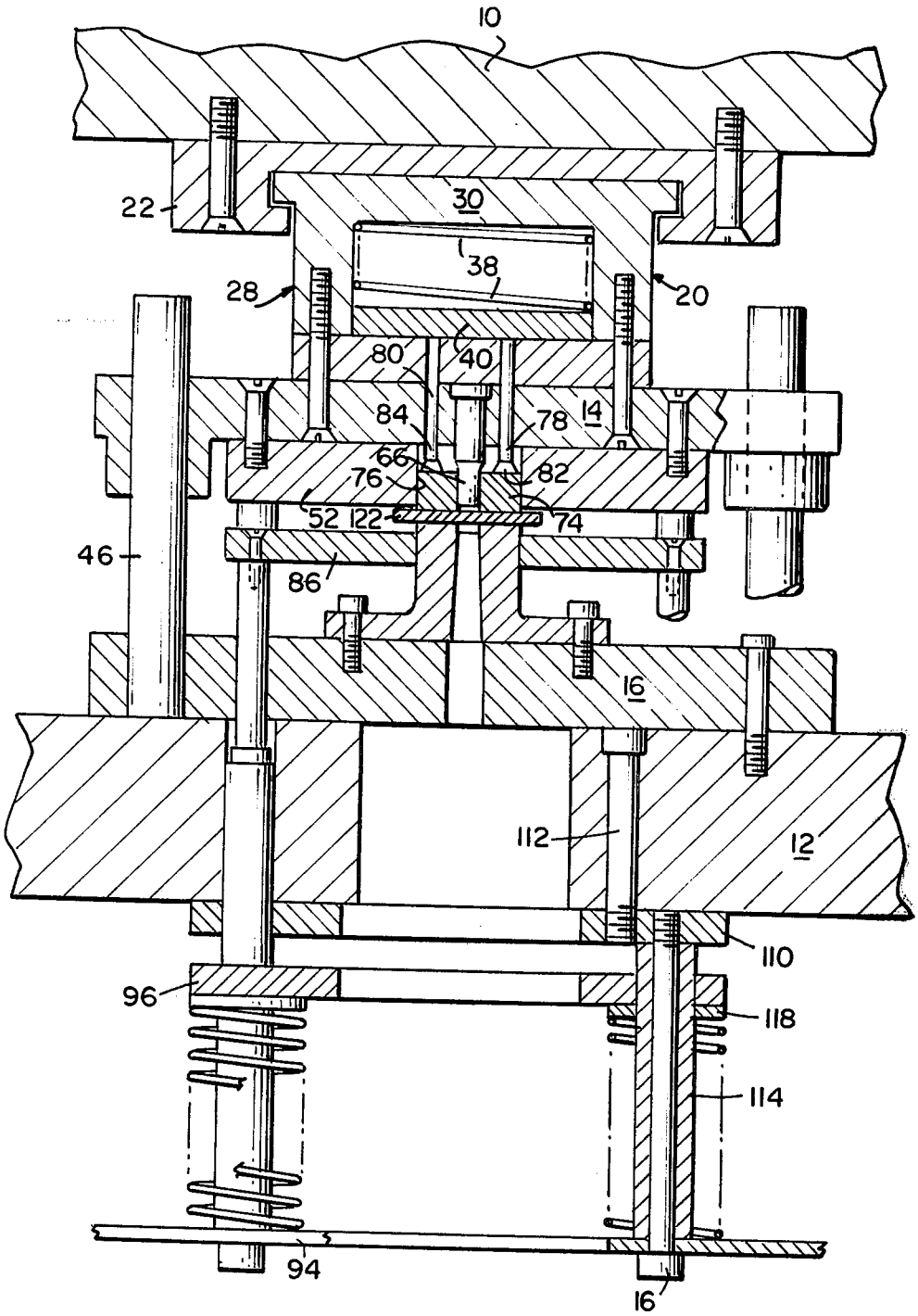
FIG. 2 is a section similar to FIG. 1 but showing the component parts of the apparatus after commencement of a piercing and blanking operation.

FIG. 2 of the drawings shows the component parts in their relative positions at the point when said secondary contact is established. Continued downward movement of the ram 10 and components carried thereby will cause the shedder 74 to be forced upwardly thereby compressing the spring element 38. This compressing action is exerted on the spring element 38 through the indermediary of the pins 78, 80 and platform 40.

At this point in the sequence of operation, the respective punches and dies commence the blanking and piercing operations. To this end, the punch 50 cooperates with the edges of the die 52 defining the bore 76. As most clearly shown in FIG. 3 of the drawings, those edges 124 of the die 52 are radiused. The provision of a radiused or rounding on the operational edges of the die 52 is crucial to the provision of a smooth edge stamping.

Figure 3:
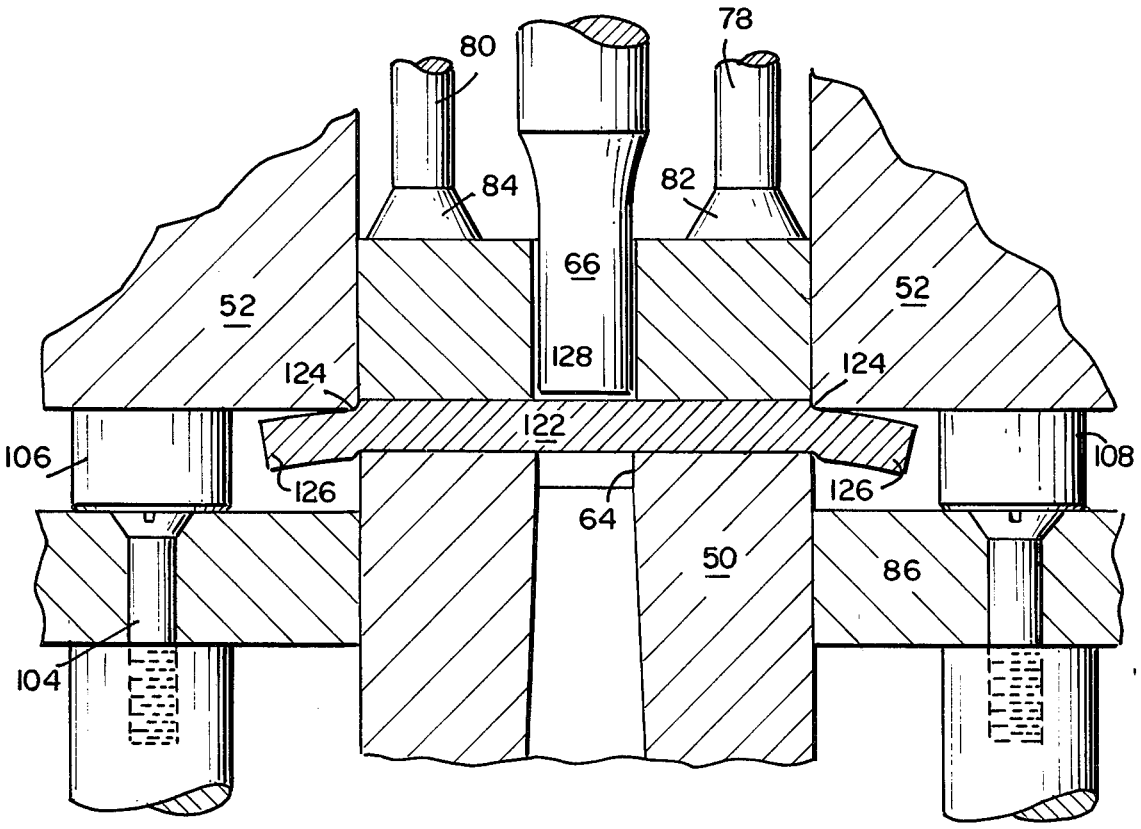
FIG. 3 is an enlarged view of a detail of the apparatus of FIGS. 1 and 2 showing some of the component parts in position during a later stage of a piercing and blanking operation.

Still referring to FIG. 3 of the drawings, it will be observed at this time that the stock is clamped only over the area which will be occupied by the finished end piece. With the stripper 86 depressed and held clear of the stock by the spacers 106, 108, the scrap material 126 around the edges of the blank is unsupported and, under the influence of the radiused edges 124 is free to flow during advance of the punch 50 into the die bore 76. In other words, the radiused edges 124 of the blanking die 52 draw the stock material around the edge of the blanking punch 50 and the scrap material is free to flow since it is not contained or held under any pressure.

In order to achieve this desired effect, it is not only crucial that the edges 124 of the die 52 are radiused but it is also very important that there be minimal clearance between the external periphery of the punch 50 and the wall portions of the die bore 76. Although "minimal" is a relative term, it will be clearly understood in the context of conventional punches and dies where it is usual to have a clearance between the punch and die equal to approximately ten percent of the thickness of the material to be stamped. In the case of the present invention, the clearance is preferably not more than one percent of the thickness of the material to be stamped.

It will be appreciated that piercing of the stock 122 by the punch 66 and die bore 64 is also brought about upon downward movement of the ram 10. As shown most clearly in FIG. 3 of the drawings, the leading end edges 128 of the punch 66 are radiused.

Although FIG. 3 of the drawings shows the respective punch and die parts relatively positioned so that the blanking operation effected by the punch 50 and cooperating die 52 begins before the piercing operation effected by punch 66 and die bore 64, it is obviously possible relatively to position the punch 66 with respect to the die 52 so that the blanking and piercing operation commence simultaneously. Alternatively, the piercing operation might be arranged to begin before the blanking operation. The time increment, if any, between commencement of the blanking and piercing operations is governed by the position of the forward end of the punch 66 with respect to the underside and radiused edges of the die 52.

Upon completion of the piercing and blanking operations, the ram 10 is retracted upwardly by the crankshaft. This, in turn, effects a withdrawal of the spacers 106, 108 thereby freeing the stripper 86 which is caused also to move upwardly under the influence of the spring means 90, 92 which transmit their force through the washers 118, 120, the support 110 and the pins 98.

Figure 4:
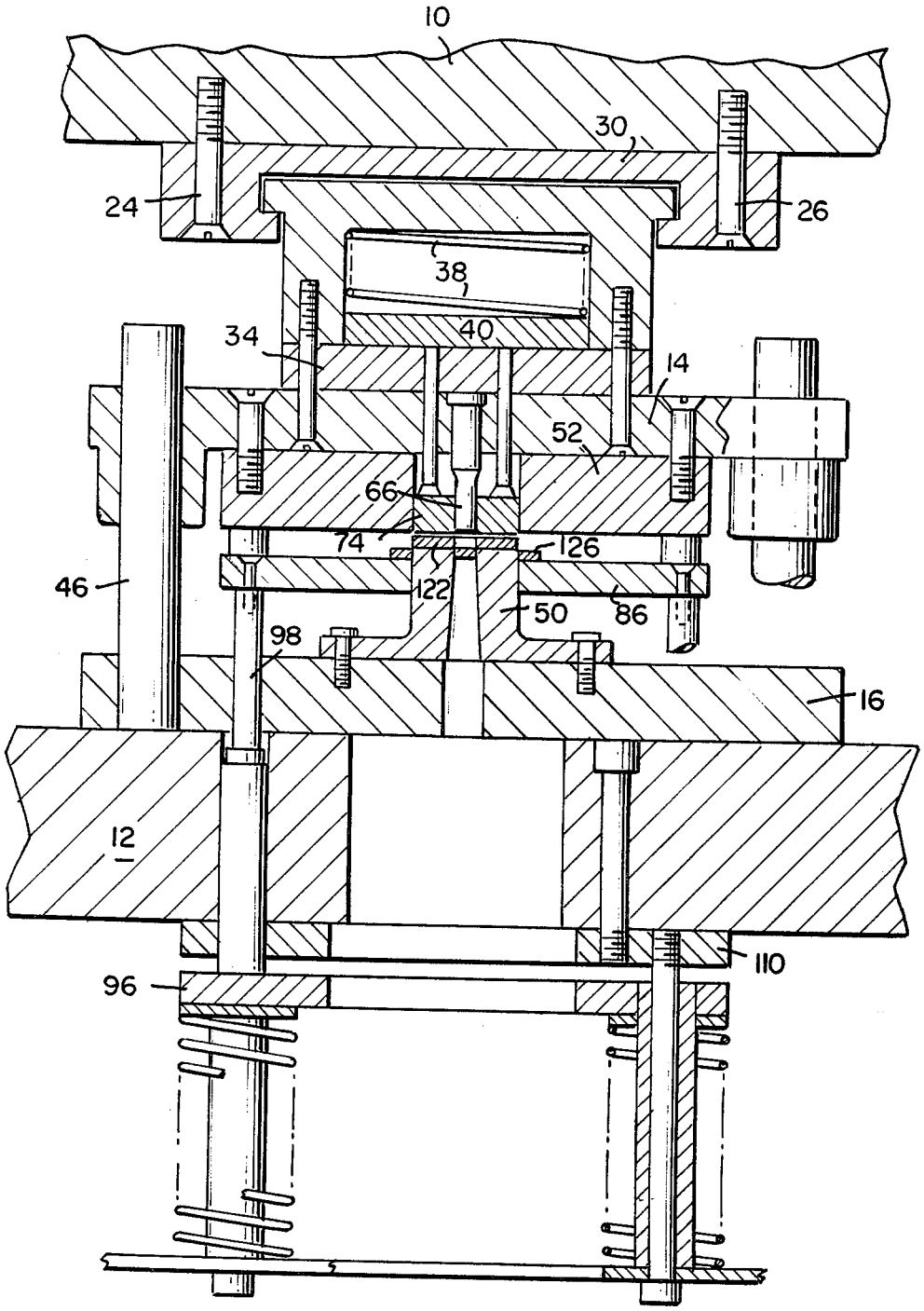
FIG. 4 is a view similar to FIGS. 1 and 2 but showing the component parts at a still later stage of a piercing and blanking operation.

This final stage in the sequence of operations is shown in FIG. 4 of the drawings. The stripper 86 is shown supporting the removed scrap 126. Further upward motion of the ram 10 from the position shown in FIG. 4 will create a space between the underside of the shedder 74 and the stamping whereupon the stamping may be removed by any convenient means and preferably by a blast of compressed air. At this point in time, it is impossible for the completed stamping to be forced back into the stock from which it was removed due to the fact that the spacers 106, 108 are more than twice the thickness of the stamping.

The radius of the die edge forming the opening is from about 0.005 inches to about 0.025 inches depending on the type and thickness of the stock material.

Although one preferred embodiment of the apparatus of the invention has been described in detail with reference to the drawings, it will be appreciated that minor modifications to that embodiment may be made within the scope of the appended claims. For example, the spring loaded power pack 20 preferably is powered by a gaseous spring which may be a nitrogen gas spring. Further, the depth of the spacers 106, 108 need only be at least twice the stock thickness where the stamping is to be blown out of the die. To comply with the inventive concept in its broadest aspect the spacers need only space the die and stripper by a distance exceeding the thickness of the stock material.

I claim:

1. A blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

2. A combination according to claim 1, wherein there is a radial clearance between the blanking punch and said opening which does not exceed 1% of the thickness of said stock.

3. A combination according to claim 1, wherein said distance is at least twice the thickness of the stock.

4. A combination according to claim 3, wherein there is a radial clearance between the blanking punch and said opening which does not exceed 1% of the thickness of said stock.

5. A combination according to claim 1, further incorporating a piercing punch and piercing die, said piercing punch extending through said shedder and said piercing die being defined by a bore extending through said blanking punch.

6. A combination according to claim 5, wherein the blanking die, the blanking punch, the piercing die, the piercing punch, the shedder and the stripper are all coaxially assembled about the axis of said bore through the blanking punch.

7. A combination according to claim 5, wherein said piercing punch has a rounded leading edge.

8. A stamping die comprising a die set in which a blanking punch and die combination is mounted, said blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

9. A stamping die according to claim 8, wherein the blanking punch is secured to a first die shoe and the blanking die is secured to a second die shoe, said first and second die shoes being relatively displaceable toward and away from each other.

10. A stamping die according to claim 9, wherein a spring loaded power pack is adapted to be disposed between a ram of a press and said upper die shoe, said power pack incorporating a housing adapted to be secured to said press ram and containing spring means arranged to exert a downward force on the shedder by means of elongate pin-like elements extending through the upper die shoe and into the bore in the blanking die to abut the shedder accommodated therein.

11. A stamping die according to claim 10, wherein the housing is in the form of an inverted cup comprising a base, wall portions depending from said base, a cover extending across said wall portions to define a chamber and an axially movable platform seated within said chamber, and contacting said pin-like elements, and wherein said spring means is disposed within said chamber between said base and said movable platform, said spring means being operable to urge said platform away from said base toward said cover.

12. A stamping die according to claim 11, wherein flanges extend outwardly from said housing base for reception in an inverted T-shaped member secured to said press ram.

13. A stamping die according to claim 9, wherein the stripper is a spring biased platform disposed around the blanking punch.

14. A stamping die according to claim 13, wherein elongate pin-like members extend through the lower die and frame part, one end of said pin-like elements contacting the underside of the stripper and the remote ends of said elements receiving said spring biassing force.

15. A stamping die according to claim 14, wherein the remote ends of said pin-like elements rest on one side of a movable platform, and wherein spring means under compression abut the opposite side of said platform to exert the spring biassing force on the stripper through the intermediary of said platform and pin-like elements.

16. A stamping die according to claim 8, wherein said distance is at least twice the thickness of the stock and there is a radial clearance between the blanking punch and said opening which does not exceed 1% of the thickness of said stock.

17. A press incorporating a stamping die comprising a die set in which a blanking punch and die combination is mounted, said blanking punch and die combination comprising a blanking die defining an opening, a cooperating blanking punch dimensioned closely to mate with said opening, the die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

18. A combination according to claim 1, wherein the radius of the rounded die edge defining said opening is from about 0.005 inches to about 0.025 inches.

* * * * *

REEXAMINATION CERTIFICATE (1329th)

United States Patent [19]

Bennett

[11] B1 4,267,753

[45] Certificate Issued Jul. 24, 1990

[54] APPARATUS FOR PRODUCING A BLANK FROM STOCK MATERIAL

[76] Inventor: Edward D. Bennett, 1401 S. Ocean Blvd. Apt. 902, Pompano Beach, Fla. 33062

Reexamination Request:
No. 90/001,815, Jul. 28, 1989

Reexamination Certificate for:

| | |
|---|---|
| Patent No.: | **4,267,753** |
| Issued: | **May 19, 1981** |
| Appl. No.: | **92,403** |
| Filed: | **Nov. 8, 1979** |

[51] Int. Cl.[5] ..... B21D 28/16; B21D 45/08

[52] U.S. Cl. ..... 83/124; 83/125; 83/126; 83/175; 83/389; 83/621; 83/690

[58] Field of Search ..... 83/124, 125, 126, 128, 83/140, 175, 389, 566, 569, 620, 621, 622, 685, 690, 698, 132, 143

[56] References Cited

U.S. PATENT DOCUMENTS

| | | | |
|---|---|---|---|
| 1,915,531 | 6/1933 | Irmis | 83/140 |
| 2,111,156 | 3/1938 | Schneider et al. | 83/140 |
| 2,369,896 | 2/1945 | Harris et al. | 83/685 |
| 2,434,692 | 2/1948 | Gauthier . | |
| 2,596,213 | 5/1952 | Conner . | |
| 3,136,181 | 6/1964 | Eckold . | |
| 3,186,284 | 6/1965 | Bennett | 83/623 |
| 3,225,410 | 12/1965 | Boyer . | |
| 3,225,411 | 12/1965 | Ribicki . | |
| 3,228,262 | 1/1966 | Bennett | 76/107 |
| 3,269,168 | 8/1966 | Anderson . | |
| 3,334,406 | 8/1967 | Bennett | 29/407 |
| 3,345,896 | 10/1967 | Bennett | 83/128 |
| 3,402,623 | 9/1968 | Bennett | 76/107 |
| 3,417,643 | 12/1968 | Bennett | 83/146 |
| 3,488,987 | 1/1970 | Stoeckli | 72/329 |
| 3,554,065 | 1/1971 | Kunz | 83/124 |
| 3,559,522 | 2/1971 | Valente | 83/571 |
| 3,564,959 | 2/1971 | Harada | 83/124 |
| 3,570,343 | 3/1971 | Wolnosky | 83/124 |
| 3,635,067 | 1/1972 | Hanas | 72/329 |
| 3,673,908 | 7/1972 | Smith | 83/685 |
| 3,687,586 | 8/1972 | Hara et al. | 425/78 |
| 4,134,716 | 1/1979 | John, Jr. | 425/186 |

FOREIGN PATENT DOCUMENTS

| | | |
|---|---|---|
| 908122 | 4/1954 | Fed. Rep. of Germany . |
| 1169404 | 5/1964 | Fed. Rep. of Germany . |
| 1805984 | 4/1971 | Fed. Rep. of Germany . |
| 2356217 | 6/1974 | Fed. Rep. of Germany . |
| 1287766 | 8/1962 | France . |
| 1518132 | 3/1968 | France . |
| 82643 | 6/1970 | German Democratic Rep. . |

OTHER PUBLICATIONS

"Fine Blanking: An In-Depth Study", Joe K. Fischlin, Stamping/Diemaking, 1972 edition.

"Fine Blanking Product Design", Michigan Precision Industries, Inc., 1978.

"Fineblanking", Franz V. Boos, Michigan Precision Industries, Inc.

"Grip Blanking" Leaflets by Ebway Corp.

European Search Report for Application EP 81 301101.2.

*Primary Examiner*—Hien H. Phan

[57] ABSTRACT

The present invention relates to a method and apparatus for producing a smooth edge blank from stock material. A blanking die is carried by the movable die shoe and a closely cooperating blanking punch is secured on the fixed die shoe. Spring biassed means is displaceably provided within the blanking die to apply pressure on a sheet of stock located on the punch only over the area to be blanked out from said sheet of stock. A piercing punch may also be provided and extends coaxially through the blanking die and a bore extending through the blanking punch provides a piercing die. The spring biassed means for applying pressure to clamp the stock only over the area to be blanked is a shedder displaceably disposed within the bore of the blanking die. A stripper encircling the blanking punch is provided for removing scrap stock upon completion of the blanking step and a spacer means is disposed to space the blanking die and the stripper apart by a distance exceeding the thickness of the stock.

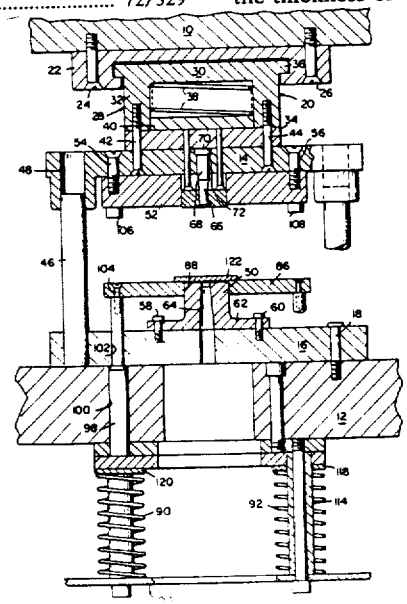

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 8 and 17 are determined to be patentable as amended.

Claims 2–7, 9–16 and 18, dependent on an amended claim, are determined to be patentable.

1. A blanking punch and die combination comprising a blanking die defining an opening *of any shape*, a cooperating blanking punch dimensioned closely to mate with said opening, *with a clearance dimension between the blanking punch and said blanking die opening of about one percent of the thickness of the stock to be blanked*, the *stock engaging blanking* die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

8. A stamping die comprising a die set in which a blanking punch and die combination is mounted, said blanking punch and die combination comprising a blanking die defining an opening *of any shape*, a cooperating blanking punch dimensioned closely to mate with said opening *with a clearance dimension between the blanking punch and said blanking die opening of about one percent of the thickness of the stock to be blanked*, the *stock engaging blanking* die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

17. A press incorporating a stamping die comprising a die set in which a blanking punch and die combination is mounted, said blanking punch and die combination comprising a blanking die defining an opening *of any shape*, a cooperating blanking punch dimensioned closely to mate with said opening *with a clearance dimension between the blanking punch and said blanking die opening of about one percent of the thickness of the stock to be blanked*, the *stock engaging blanking* die edge defining said opening being rounded, a stock engaging shedder displaceable within said die opening to engage and clamp stock, a stripper encircling said blanking punch and displaceable therealong to remove surplus stock after a blanking operation and spacer means disposed between the blanking die and the stripper to space the blanking die and the stripper apart by a distance exceeding the thickness of said stock.

* * * * *